United States Patent [19]

Mizushima et al.

[11] Patent Number: 4,461,462

[45] Date of Patent: Jul. 24, 1984

[54] APPARATUS FOR COOLING STEEL PIPE

[75] Inventors: Nobuyuki Mizushima; Kyohei Murata; Hiroshi Tamaki; Junichi Hayashi; Fujio Ohkubo, all of Kitakyushu, Japan

[73] Assignee: Nippon Steel Corporation, Tokyo, Japan

[21] Appl. No.: 442,438

[22] Filed: Nov. 17, 1982

[30] Foreign Application Priority Data

Nov. 18, 1981 [JP] Japan ..... 56-183639

[51] Int. Cl.[3] ..... C21D 1/63

[52] U.S. Cl. ..... 266/117; 148/155; 266/134

[58] Field of Search ..... 266/114, 117, 119, 134; 148/153, 155, 143

[56] References Cited

U.S. PATENT DOCUMENTS

| | | | |
|---|---|---|---|
| 2,188,257 | 1/1940 | Urschel | 134/105 |
| 2,748,038 | 5/1956 | Adair et al. | 266/117 |
| 2,834,592 | 5/1958 | Adair et al. | 266/117 |
| 3,623,716 | 11/1971 | Fritsch et al. | 148/143 |
| 3,749,384 | 7/1973 | Werner | 266/117 |
| 3,804,390 | 4/1974 | Jennings et al. | 266/117 |
| 4,116,716 | 9/1978 | Itoh et al. | 134/134 |
| 4,336,924 | 6/1982 | Day | 266/117 |

FOREIGN PATENT DOCUMENTS 2505361 11/1982 France .

*Primary Examiner*—L. Dewayne Rutledge
*Assistant Examiner*—Christopher W. Brody
*Attorney, Agent, or Firm*—Wenderoth, Lind & Ponack

[57] ABSTRACT

A method and apparatus for cooling at least the inside of steel pipes. Cooling is effected while restraining the radial displacement of a pipe at a point not more than 500 mm, or preferably not more than 250 mm, away from each end of the pipe and at intermediate points spaced at intervals of 1.0 m to 2.5 m. Elliptical deformation in the cross section of larger-diameter pipes also is prevented by adding to the aforementioned cooling method and apparatus a device and step to rotate the pipe being cooled at a rate of 30 to 150 times per minute. The restraining device at one end of the pipe is designed to move in the direction of the pipe axis so that the restraint of the radial displacement at a point not more than 500 mm away from that end is at all times ensured even when the pipe length varies.

9 Claims, 8 Drawing Figures

APPARATUS FOR COOLING STEEL PIPE

BACKGROUND OF THE INVENTION

This invention relates to a method and apparatus for cooling hot steel pipe without causing the pipe to bend along its length so as to damage the roundness of its cross section.

When steel pipe is cooled rapidly from such a high temperature as, for example, 850° C. for the purpose of heat treatment, the pipe may deform unless the cooling proceeds evenly in the circumferential and axial directions thereof.

Deformation of steel pipe occurring during the cooling process can be classified as "bend" which is the impairment of straightness in the axial direction and "elliptical deformation" which is the impairment of roundess in the cross-sectional plane.

The bent or elliptically deformed pipe handling in the subsequent process is difficult or impossible to handle during subsequent processing.

The two kinds of deformation developed during the heat treatment process can be corrected by the described in the following. application of corrective mechanical force on a cold pipe. This however, leaves internal stress within the pipe.

When used in deep oil wells, wells producing high-pressure gases, sour oils and gas wells, and wells in cold districts and in other hostile conditions, pipes not free of internal stress may collapse under low pressure or develop stress-corrosion cracking. Therefore, cold-correction is not always desirable depending upon the kind of service into which pipes are put.

The pipe deformation developed during the cooling process can be corrected to a considerable extent; by, for correcting the bend, by straightening, and for correcting the elliptical deformation, by warm sizing immediately after tempering. Yet, a certain amount of detrimental deformation remains unremoved sometimes. If a thread is cut at the end of such a pipe after heat treatment, the thread will not turn out to be satisfactory.

The bend of pipe is commonly corrected by use of a multi-roll straightener comprising concave-drum-shaped rolls set in an intersecting fashion. The multi-roll straightener can straighten a long-order bend extending throughout the entire length of a pipe with high accuracy. However, this method is capable of improving any minor bend at the pipe end only approximately 50 percent because of the limitations imposed by its roll arrangement.

Turning that is given to pipes being conveyed or waiting in the walking-beam type tempering furnace followed the quenching process also corrects a long-order bend along the pipe length to some extent, but this method also is not very effective for a minor pipe-end bend.

When such a pipe-end bend is left uncorrected even after tempering or straightening, no good straightness or satisfactory thread cutting can be hoped for in the finished pipe. This pipe-end bend shows a strong tendency to appear in small-diameter, light-wall pipes, such as those having an outside diameter not larger than 100 mm.

Elliptical deformation of a pipe is usually corrected by passing it, after tempering, through a sizing mill while applying a small amount of reduction, which commonly comprises three stands each of which has two or three rolls forming a circular pass.

But any pipe the cross-section of which became heavily elliptical in the quenching process passes through this mill uncorrected to the subsequent process.

This multi-roll straightener also corrects the roundness of a pipe when it straightens its bend, but only to the extent of approximately 50 percent.

Like the axial bend, the elliptical deformation also has an adverse effect on the thread cutting at pipe ends and the collapse strength of pipe in high pressure wells.

Elliptical deformation occurs mainly on larger-diameter pipes.

For the reason described previously, high-grade seamless steel pipes for oil-well applications tolerate very little deformation. Therefore, they call for a cooling means which cause little or no deformation in the cooled pipe.

This invention aims at providing a cooling means which ensures the production of steel pipes having little or no deformation.

SUMMARY OF THE INVENTION

The object of this invention is to provide a method and apparatus for cooling steel pipes without developing deformation.

To be more specific, the object of this invention is to provide a method and apparatus for cooling steel pipes that particularly prevent the development of bend at the pipe ends and elliptical deformation of the pipe cross section.

In cooling a pipe from both inside and outside, for the purpose of heat treatment, radial displacement of the pipe is restrained within the range of 500 mm, or preferably 250 mm, from both ends thereof, while the whole length of the pipe is restrained at a multiplicity of points spaced at intervals of 1.0 to 2.5 m.

Alternatively, a pipe the radial displacement of which is restrained within the range of 500 mm, or preferably 250 mm, from both ends thereof, and the whole length of which is restrained at a multiplicity of points spaced at intervals of 1.0 to 2.5 m, is cooled from both inside and outside while being rotated about its axis.

The cooling means described above assures the production of heat-treated steel pipes with little or no bend, particularly at the pipe ends and with a high degree of roundness in cross section.

The combination of the radial restraint within the range of 500 mm, or preferably 250 mm, from the pipe ends and the multi-point restraint at 1.0 to 2.5 m intervals plays a decisive role in the production of bend-free heat-treated steel pipes according to this invention.

It is important for a pipe to be cooled in such a state that its radial displacement is restrained at points not more than 500 mm away from the both ends thereof. It is therefore necessary to ensure that a pipe of any length always be secured at such points. Accordingly, means to restrain one end of a pipe is designed to slide freely in the axial direction of the pipe, thereby permitting the radial displacement of the pipe to be restrained at the predetermined point.

Addition of means to rotate the pipe about its axis prevents the occurrence of elliptical deformation that is likely to occur when light-wall, large-diameter pipes are cooled.

DETAILED DESCRIPTION OF THE PREFERRED EMBODIMENTS

Figure 1:
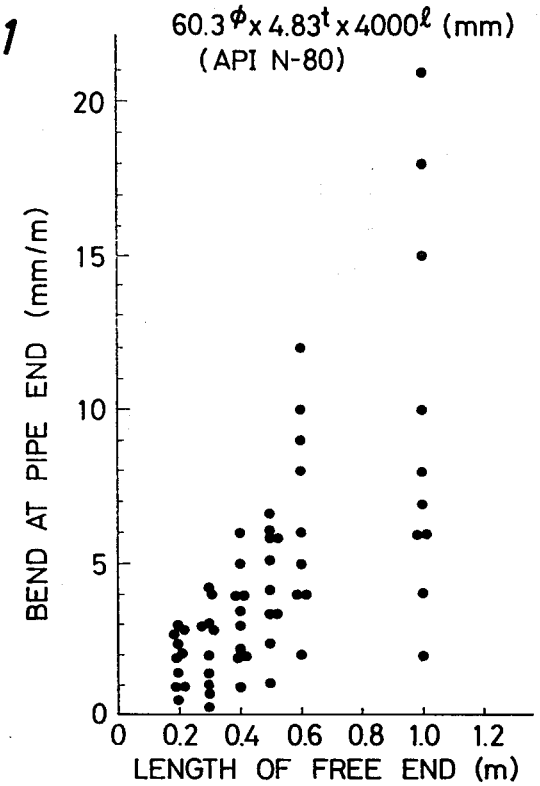
FIG. 1 is a graph showing the relationship between the end bend and the length of the free end of a pipe that is quenched from both inside and outside.

This invention provides a method and a commercial-scale apparatus for hardening or cooled steel pipes, including upset pipes, of all dimensions ranging from small to large in diameter, from light to heavy in wall thickness, and short to long in length, on one and the same cooling apparatus, without the cooled pipes developing any deformation. In quenching pipes by using the method and apparatus of this invention, no bends, especially those at the pipe ends, occur even in smaller-diameter pipes the outside diameter of which is not larger than 100 mm and no elliptical deformations of the cross section occur in larger-diameter pipes.

Principally this invention aims at preventing the occurrence of a pipe bend, especially at the pipe end, during the cooling process for hardening the material of the pipe. One of its major aim is to provide a cooling means that develops little or no bend in pipes with relatively small diameters that are likely to bend. Another important aim is to cool larger-diameter pipes without deforming their round cross section into elliptical form.

Several techniques to perform deformation-free quenching have been studied heretofore.

One of such techniques is both-side dip quenching. For inside cooling according to this method, it is necessary to provide the necessary flow rate of coolant on the inside of a pipe according to the inside diameter and length thereof. For outside cooling, it is necessary to provide a spray nozzle in such a manner that uniform cooling is provided along the circumference and length of a pipe and also to spray as much water as is appropriate for the surface area thereof. A technique to provide a uniform cooling over the circumference of a pipe through the rotation of the pipe being cooled is also referred to in, for example, Japanese Patent Publication No. 44735 of 1982.

However, none of these conventional cooling techniques are satisfactory because their deformation-preventing effects have their limits.

Steel pipes to be quenched themselves also have several characteristics that can cause or lead to deformation. The heat transfer coefficient and the circumferential temperature distribution vary with the surface condition of a heated steel pipe. Also, the cooling rate varies if there is any wall thickness eccentricity. If there are these variations, different parts of the pipe being quenched will shrink and/or expand, as a result of transformation, at different rates during the cooling operation. Such uneven shrinkage and/or expansion gives rise to thermal stress which, in turn, results in the deformation of the pipe.

A pipe deformed during cooling gets out of its proper cooling position, as a result of which the pipe no longer retains the positional relationship with the cooling apparatus that is necessary for the achievement of the desired cooling. This also furthers the unbalanced cooling of the pipe.

This phenomenon occurs more at the pipe ends than elsewhere, and is more severe the longer the free end of the pipe being cooled.

The existing both-side dip quenching and other conventioanl pipe cooling techniques paid no attention to the effect the length of the free end of a pipe exerts on the bend that occurs during or after cooling.

Owing to equipment design limitations, pipes of certain lengths have been cooled in what may be called the cantilevered state in which a long portion of the pipe end is left unsupported.

The aforementioned technique disclosed in Japanese Patent Publication No. 44735 of 1982 cools both the inside and outside of a pipe while it is restrained at three points along the length thereof and rotated about the axis thereof. Nevertheless, nothing is disclosed as to the magnitude of the effect the length of the free end exerts on the pipe being cooled and no technical measure is disclosed to cope with the variation in pipe length.

The inventors have discovered that the pipe end bend is remarkably improved by restraining the pipe at a point close to each end of the pipe at all times, as a result of a number of experiments on the method of restraining the pipe being cooled.

One of the characteristics of the pipe cooling method and apparatus according to this invention is that small diameter pipes which are likely to bend at the ends, such as those the outside diameter of which is not larger than 100 mm, are restrained at a point not more than 500 mm, or preferably not more than 250 mm, away from each end and also at intermediate points spaced at intervals of 1.0 to 2.5 m along the length of the pipe.

The permissible length of the free end from the viewpoint of bend prevention depends upon the size of the pipe to be cooled. From the results of the experiments conducted by the inventors, it seems preferable to restrain the radial displacement of a pipe at a point not more than 500 mm, or preferably not more than 250 mm, away from each end thereof.

There are two methods of restraining a pipe; one is for stationary quenching (cooling) that does not rotate the pipe in the cooling vessel, and is achieved by use of a V-shaped pipe support and a device to clamp the pipe from above, and the other is for rotary quenching (cooling) employing turning rolls that support and rotate the pipe and pinch rolls that guide the rotating pipe while exerting a pressure from above. Both methods of restraining pipe have proved to produce substantially the same effect under the same conditions on a wide variety of pipes.

The following paragraphs describe how and why the multi-point restraint, especially at the pipe ends, prevents the occurrence of pipe bend, especially at the pipe ends.

The inventors conducted a quenching test by passing a coolant only through the inside of pipes which were surrounded by the atmosphere. The test revealed that a longer free end makes a more complex and larger motion during cooling, eventually producing a greater pipe-end bend. FIG. 1 shows a typical relationship between the length of the free end of a pipe the inside and outside of which are subjected to quenching and the resulting bend at the end thereof. As shown, even a pipe with an outside diameter of 60.3 mm does not develop an end-bend exceeding 6 mm/m in magnitude if the length of its free end is kept within 500 mm, and scarcely any end-bend develops if the free end length is held within 250 mm.

Figure 2:
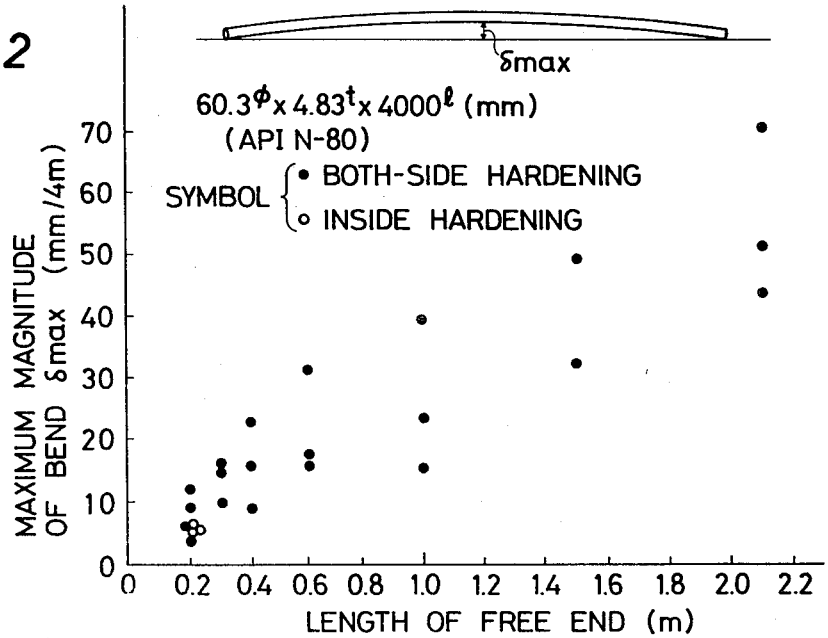
FIG. 2 is a graph showing the relationship between the overall bend and the length of the free end of a 4 m long pipe.

With a pipe quenched on both inside and outside, there exists an interrelationship between the long-order bend along a pipe and the minor bend at the pipe ends. It has been empirically known that the incidence of end-bend increases if the cooling condition and equipment are such that will develop a large long-order bend. By varying the length of the free end, the end-bends on inside and outside-quenched pipes were measured as shown in FIG. 1. The greater the length of the free end, the greater the bend which will result from the quenching on both inside and outside. FIG. 2 shows that the out-of-straightness of lighter-wall, smaller-diameter pipes is greatly improved, developing little overall bend, if the length of their free ends is held below 500 mm, or preferably below 250 mm.

The pipes used in the experiments shown in FIGS. 1 and 2 were 4 m in length. It has been ascertained through the experiments on the existing inside and outside quenching apparatus that the same result will be obtained with pipes ranging in length between approximately 12 m and 14 m since the intermediate portion of each pipe is restrained at intervals of 1.0 m to 2.5 m.

A quenching test was conducted on an existing inside and outside dip quenching apparatus, using seamless steel pipes according to A.P.I. N-80 having a diameter of 60.3 mm, a thickness of 4.83 mm, and a length of 9.85 m. When restrained at intervals of approximately 3.5 m to 4.5 m, the pipes bent to a large degree, such as 150 mm to 200 mm maximum. But the bend decreased sharply when pipes were restrained at points not more than 500 mm away from both ends and at intervals of 1.0 m to 2.5 m in between. That is, when a pipe is restrained at many points, including those near both ends thereof, according to the method of this invention, the quenching-induced bend does not increase either in incidence or in magnitude with an increase in pipe length, such as has been the case with the conventional quenching operations as described in Japanese Petent Publication No. 44735 of 1982.

The mechanism by which the multi-point restraint provided at both ends and in the intermediate portion of a pipe prevents the long-order and end bends may be explained as follows. Even when an unbalanced stress arises at a certain specific point of area or time, the impact of such a great localized stress is soon relieved as the stress gradually spreads into the neighboring areas because the pipe being quenched is restrained at many points. The eventual residual stress is so small that the pipe hardly bends even after the multi-point restraing has been released.

With the conventional inside and outside dip quenching method, it has been impossible to prevent the quenching-induced bends in small-diameter, light-wall pipes, and such bends have required a heavy straightening in the subsequent process. This invention now makes it possible to apply a bend-free quenching to a wide variety of pipes including upset ones, ranging from small to large in diameter, light to heavy in wall thickness, and short to long in pipe length, through the provision of the multi-point restraint at points not more than 500 mm away from both ends and at intervals of 1.0 m to 2.5 m in between. This has greatly increased the need for the straightening work in the subsequent process. All this results in a great commercial advantage.

Now it has been ascertained that restraining both ends of a pipe prevents the occurrence of bend, especially at the pipe end. Still, appropriate design consideration is needed to ensure that an appropriate apparatus is provided which will restrain the proper point at each end of pipes of various lengths at all times.

According to this invention, end stops are provided at several reference points from which a suitable one is chosen depending upon the length of a pipe received from the hardening furnace. A stationary restraining device is provided at a given distance from each reference point so that a given position at one end of the pipe is at all times restrained during quenching. A movable restraining device is also provided to restrain a given position at the other end of the pipe the one end of which is fixed by the end stop. The movable restraining device is capable of changing its position within a distance that is smaller than the interval at which said reference points are set.

An inside cooling nozzle to inject coolant into a pipe may be provided at either end of the pipe. In this invention, the nozzle is provided on the end where the movable restraining device is placed and the position of the pipe end varies less. The inside cooling nozzle is designed to move along with the movable restraining device so that a constant distance is always kept between the nozzle, the restraining device, and the pipe end irrespective of the pipe length. Further, provisions are made so that the height of the restraining device and the inside cooling nozzle and the distance from the pipe end to the nozzle can be adjusted as the pipe diameter changes.

It is also possible to always restrain both ends of a pipe without employing said combination of the stationary and movable restraining devices. Any such method, however, is disadvantageous because of some design and layout limitations. If, for example, all of the restraining devices are stationary, they must be spaced at intervals of not more than 500 mm in order that both ends of a pipe are restrained at a point not more than 500 mm away from each end. Such an arrangement, however, makes many dead angles for application of coolant on the outside of a pipe because of the limitations imposed by the relationship with the charging and discharging devices and the position of the outside cooling nozzle. This will pose various hardening problems, such as a non-uniform hardening of heavy-wall and low-hardenability pipes. It will also impair the roundness of pipes, and call for a larger capital investment.

The relationship between the unbalanced cooling and pipe bends and the measures to prevent such bends have been described in the foregoing. It is also necessary to prevent the elliptical deformation of pipe cross section which also results from the unbalanced cooling as mentioned previously.

The elliptical deformation of a pipe arises when the pipe is unevenly cooled around the circumference thereof. To prevent the elliptical deformation, therefore, it is necessary to give as uniform a cooling as possible over the circumference.

Prevention of the elliptical deformation on an inside and outside dip quenching apparatus centers on the application of an even cooling on the outside of pipes. This may be achieved by providing many outside cooling nozzles around the outside wall of a pipe. But the need to install the charging and discharging devices, a supporting table, etc. limits the number of such nozzles. Besides, such devices are likely to disturb the flow of applied water in the cooling vessel. It may also be possible to reduce the nonuniform circumferential cooling by increasing the quantity of water applied to the outside of a pipe and vigorously stirring the water in the cooling vessel. But this method also has several disadvantages. It cannot provide a uniform cooling along the length of a pipe because the supporting table in the water vessel prevents the smooth flow of water, thereby causing nonuniform cooling. The use of a large amount of water increases costs, as well.

The inventors have discovered a cost-advantageous method to eliminate the elliptical deformation through the minimization of uneven cooling. According to this method, outside cooling nozzles are arranged in a substantially horizontal row on each side of a pipe being quenched in order to minimize the consumption of water and the area in which smooth water flow is hampered. Further, the pipe being quenched is rotated at a rate of 30 to 150 times per minute in order to minimize the nonuniform cooling around the circumference thereof. The outside cooling nozzles on both sides of the pipe are spaced at intervals of not more than 300 mm and arranged in a staggered fashion in order to prevent localized deformation along the length of the pipe. This method has reduced the magnitude of elliptical deformation by half.

Figure 3:
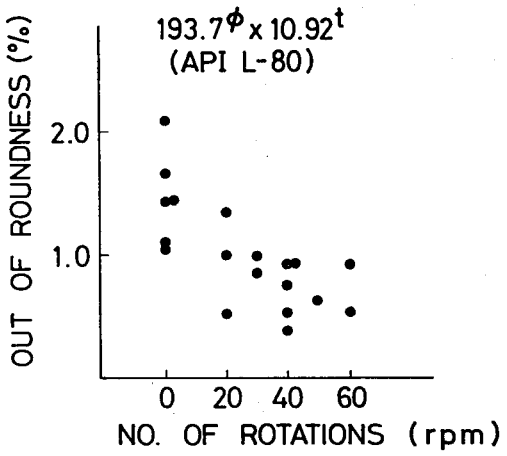
FIG. 3 is a graph showing the difference in the roundness of a pipe that is cooled under the conditions according to this invention with and without rotation about its axis.

FIG. 3 shows how the elliptical deformation (or out of roundness) of pipes changed in an experiment conducted under the aforementioned conditions, with the pipes rotated at a rate of 20 to 60 times per minute.

The reason why the number of pipe rotations is limited to between 30 and 150 times per minute is as follows.

For pipes of relatively large diameter, as shown in FIG. 3, out-of-roundness was greatly improved and stabilized at a rotating rate of not much over 30 times per minute since even such a low rotating rate produces a high peripheral speed. In the case of a light-wall pipe with a smaller diameter (60.3 mm), the desired improvement and stabilization in pipe bend and roundness were achieved at a relatively higher rotating rate between 60 and 150 times per minute. From the results of these experiments and simulative calculation of the temperature of pipe during cooling, it has been ascertained that the proper pipe rotating rates falls somewhere between 30 and 150 times per minute. That is, a cooling apparatus designed to rotate pipes at a rate of 30 to 150 times per minute suffices for practical purposes. Rotating pipes more than 150 times per minute is not only unnecessary but also a waste of power.

Now, preferred embodiments of this invention will be described by reference to the accompanying drawings. FIGS. 4 through 7 illustrate a quenching apparatus according to this invention. in FIG. 4, a pipe 20 moves downward in the figure. A hardening furnace 1 is followed by skids 2 which are, in turn, followed by an aligning table 3. On the aligning table 3 are disposed concave-drum-shaped rollers 4 which are spaced at given intervals and adapted to be rotated by an electric motor (not shown). Up-down stops 5*a*, 5*b* and 5*c* are provided in the right part of the aligning table 3 (FIG. 4) to stop the pipe 20 at reference positions a, b and c. The aligning table 3 also is equipped with kickers 6 to discharge the pipe 20 and skids 7 to deliver the kicked-out pipe 20 to a subsequent quenching apparatus. The quenching apparatus comprises a water vessel 8, stationary restraining devices, a movable restraining device, and an inside cooling nozzle. The stationary restraining devices are spaced at given intervals between the positions corresponding to said up-down stops 5*a*, 5*b* and 5*c* and the movable restraining device. Each stationary restraining device comprises a support 9 and a clamp 10 that is fluidically opened and closed. The movable restraining device comprises a support 12 and a clamp 13, which are identical with those of the stationary restraining device, mounted on a transfer car 11. A cylinder 14 moves the transfer car 11 back and forth in FIG. 5. The transfer car 11 also carries an inside cooling nozzle 15. The position of the nozzle 15 relative to the movable restraining device is changed by means of a vertical position adjuster 16 and a horizontal position adjuster 17. The quenching apparatus is followed by kickers 18 to discharge the pipe 20 from the water vessel and skids 19 for further delivery of the pipe.

Figure 6:
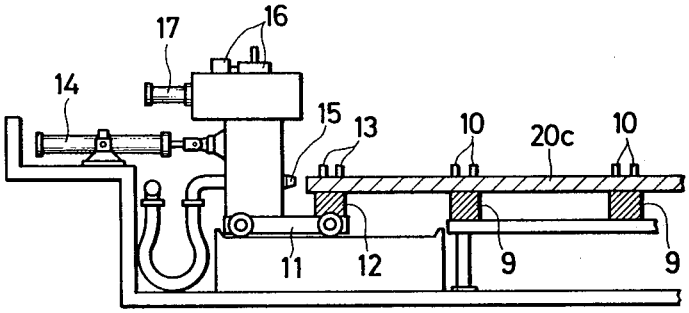
FIG. 6 is a partial side elevation of the same quenching apparatus showing its nozzle in the withdrawn position.
Figure 7:
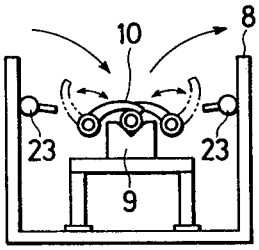
FIG. 7 is a cross-sectional view of a pipe restraining device of the same quenching apparatus.
Figure 4:
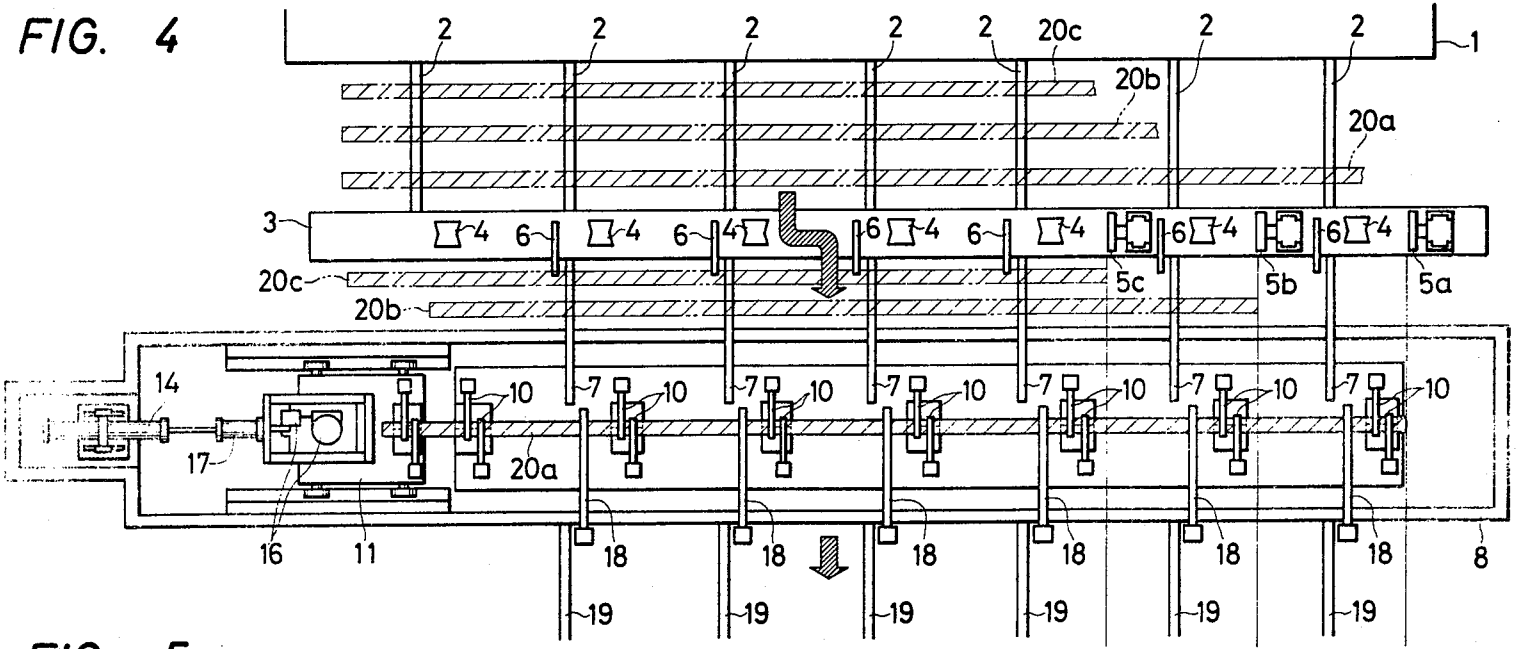
FIG. 4 is a plan view of a quenching apparatus according to this invention.
Figure 5:
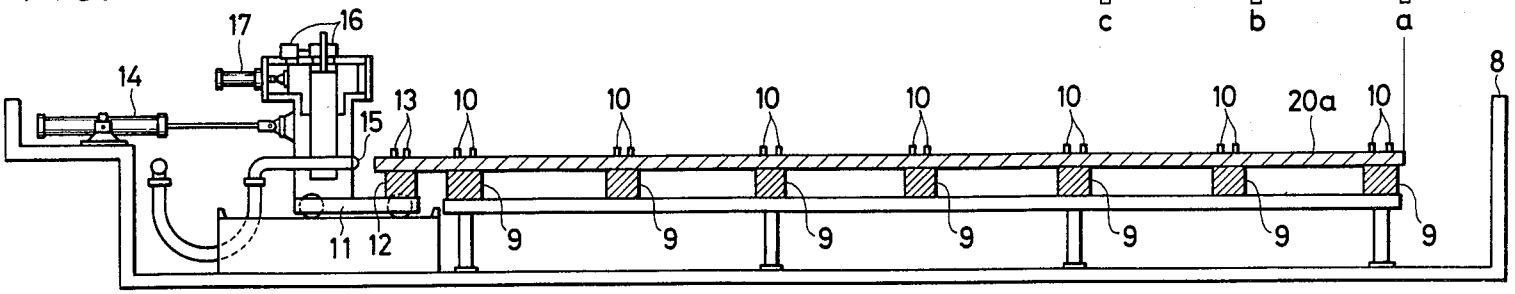
FIG. 5 is a side elevation of the same quenching apparatus showing its nozzle in the advanced position.

The following is a description of a case in which pipes 20*a*, 20*b* and 20*c* of three different lengths are treated. When a pipe 20*a* is to be quenched, the stop 5*a* is raised to stop the right end of the pipe at reference point a. For pipes 20*b* and 20*c*, the stops 5*b* and 5*c* are raised to stop the right end of the respective pipes at reference points b and c, respectively. That is, the right end position of the pipe is chosen from the stops 5*a*, 5*b* and 5*c* depending upon the length of the pipe. When the right ends of the pipes 20*a*, 20*b* and 20*c* are stopped at the reference points a, b and c, the left ends of the pipes are at different points as shown in FIG. 4. This difference requires the movement of the movable restraining device and the inside cooling nozzle. FIGS. 5 and 6 show the position of the transfer car 11 for the pipes 20*a* and 20*c*, respectively.

Now the movement of the pipe through the apparatus will be explained. The pipe 20 heated in the hardening furnace 1 is taken out through the discharge door (not shown) thereof, sent over the skids 2, and dropped on the aligning table 3. The rollers 4 on the aligning table 3 immediately begin to turn to deliver the pipe 20 to the right in FIG. 4. Then the pipe 20 stops striking against the stop 5 that has been raised in readiness, and then is kicked out by the kicker 6 onto the skids 7 for delivery into the water vessel 8 in which the pipe 20 rests on the supports 9 and 12.

As soon as the pipe 20 stops in the quenching position at the center of the support 9, it is restrained by the clamps 10 and 13. The moment the clamps restrain the pipe, the inside cooling nozzle 15 ejects water to cool the inside of the pipe 20. The flow rate of the cooling water running through a long pipe, usually ranges from approximately 2.5 m to 30 m per second, varying with the pipe diameter, wall thickness and length. Outside cooling begins the moment the pipe drops in the water vessel, with water applied from the outside cooling nozzles 23 as required. When it has been thoroughly cooled, the pipe 20 is kicked out by the kicker 18 and rolls over the skids 19 to the subsequent process.

Another embodiment of this invention has a pipe rotating mechanism added to the embodiment described above. In this second embodiment, the pipe 20 is restrained by turning rolls and pinch roll, instead of the supports 9 and 12 and the clamps 10 and 13 in the first embodiment. Other functions are the same as those of the first embodiment.

Figure 8:
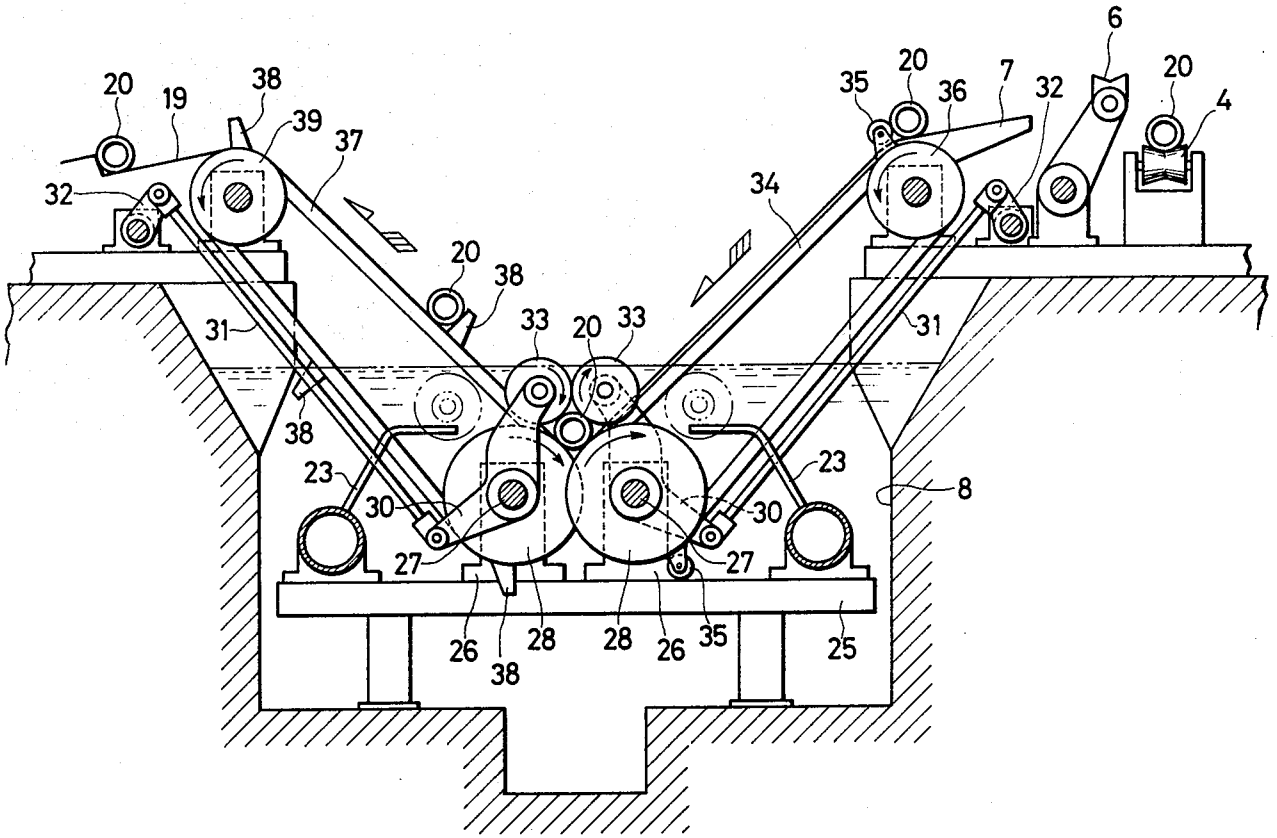
FIG. 8 is a cross-sectional view of a quenching apparatus based on the rotary quenching concept.

The second mebodiment is shown in FIG. 8, in which the parts similar to those shown in FIGS. 4 and 5 are designated by similar reference numerals, with the description of such parts being omitted.

There is a support table 25 in a water vessel 8. On the support table 25 are mounted plural sets of paired pedestals 26 spaced at intervals along the length of the water vessel 8 (in the direction at right angles to the drawing).

The paired pedestals 26 support rotary shafts 27, to which pairs of turning rolls 28 are attached in such a manner that part of one roll in each pair overlaps part of the other roll when viewed from above. Each rotary shaft 27 is driven by a drive assembly comprising a motor equipped with a reduction gear, a sprocket, and a chain (not shown).

A rotatable bell crank lever 30 is attached to each of the rotary shafts 27. To one end of the bell crank lever 30 is coupled a linkage 31 extending outside the water vessel 8. The bell crank lever 30 is moved by a fluid-operated drive 32 through the linkage 31. A rotatable pinch roll 33 is attached to the other end of the bell crank lever 30.

A rotatable sprocket (not shown) is attached to the rotary shaft 27 at the right. Over this sprocket and a sprocket 36 on the outside of the water vessel 8 is passed, the sprockets, chain and dog constituting conveyor.

A rotatable sprocket (not shown) is attached to the rotary shaft at the left. A conveyor chain 37 having a dog 38 is passed over this sprocket and a sprocket 39 outside the water vessel 8, the sprockets, chain and dog constituting a discharging conveyor.

Although not shown, the apparatus illustrated in FIG. 8 is equipped with the transfer car 11, nozzle 15 and so on shown in FIG. 4. The transfer car carries the bell crank lever 30 carrying said turning roll 28 and pinch roll 33 which are driven by a fluid-operated drive (not shown) mounted on the same transfer car.

In this apparatus, the pinch rolls 33 are open before the pipe 20 enters the water vessel 8, and then close to restrain the pipe 20 the moment the pipe 20 is placed on the turning rollers 28 by the charging conveyor. The turning rollers 28 are rotated, either before or after the pipe 20 is put thereon, to turn the restrained pipe. The rotation continues while the pipe 20 is being cooled. On completion of cooling, the turning rolls 28 stop rotating, the pinch rolls 33 open, and the discharging conveyor delivers the pipe 20 out into the subsequent process.

Pipes are charged over the skids and discharged by the kicker in one of the two embodiments described above, and charged and discharged by the conveyor chains in the other. It is also possible to charge and discharge pipes with the use of kickers or a combination of a kicker and a conveyor chain.

As will be evident from the above description, the pipe cooling method and apparatus according to this invention minimize the bend of pipes, especially at the ends thereof, thereby eliminating all troubles resulting from the bend. Addition of the pipe rotating mechanism reduces the elliptical deformation of the pipe cross section as well as the bend of smaller diameter pipes. The resulting product quality improvement provides a large advantage. The pipe cooling method and apparatus of this invention are cost-advantageous in that they are capable of processing pipes of various lengths and diameters on one and the same apparatus.

What is claimed is:

1. An apparatus for cooling at least the inside of steel pipes of various lengths by passing a coolant through the pipes, comprising:

a plurality of stop means spaced at intervals in a straight line in the direction of the length of a pipe to be cooled for selectively stopping one end of the pipe which is moved axially of the pipe axis toward said stop means at the position of one of said stop means;

pipe moving means for moving the pipe which is delivered from a pipe heat treatment means axially of the pipe toward said stop means;

a plurality of stationary pipe restraining means for restraining the pipe from radial expansion and movement laterally of the pipe axis, said stationary pipe restraining means being spaced in a straight line along the axis of the pie at the same intervals as between said stop means and there being a stationary pipe restraining means spaced in the direction of the axis of the pipe from the position of each stop means a short distance relative to the size of said intervals;

a movable pipe restraining means for restraining the pipe from radial expansion and movement laterally of the pipe axis, said movable pipe restraining means being spaced along the axis of the pipe from the stationary pipe restraining means which is farthest along the axis of the pipe in the direction from which the pipe is moved toward said stop menas, and being movable along the pipe axis to a position for engaging the end of the pipe which is toward said movable pipe restraining means at a point closely adjacent said end of the pipe; and nozzle means on said movable pipe restraining means and being positioned for being directed into said pipe for directing a cooling fluid into the pipe when said movable pipe restraining means engages said pipe.

2. An apparatus as claimed in claim 1 in which said movable pipe restraining means includes a movable transfer car on which said nozzle means is adjustably mounted for movement transversely of the axis of the pipe and parallel to the axis of the pipe for positioning the nozzle means in the desired position for different sizes of pipe.

3. An apparatus as claimed in claim 1 in which said stationary pipe restraining means are spaced no more than 500 mm along the axis of said pipe from the position of said stop means and are spaced at intervals along the axis of the pipe of from 1 m to 2.5 m, and said engaging position of said movable pipe restraining means is no more than 500 mm from the end of said pipe.

4. An apparatus as claimed in claim 1 further comprising a cooling fluid means for applying cooling fluid to the exterior of the pipe.

5. An apparatus as claimed in claim 1 further comprising means for rotating the pipe.

6. An apparatus as claimed in claim 5 in which said means for rotating the pipe comprises means for rotating the pipe at a speed of from 30 to 150 times per minute.

7. An apparatus as claimed in claim 5 in which said pipe restraining means comprises a pair of closely adjacent lower rolls having the circumferences overlapping when viewed from above, and a pair of pinch rolls above said lower rolls and reciprocally movable over and away from said lower rolls for permitting a pipe to be placed on said lower rolls, and said means for rotating the pipe comprises means for rotating said lower rolls.

8. An apparatus as claimed in claim 7 further comprising a liquid vessel for containing a cooling liquid, and in which said pipe restraining means is positioned for being covered with the liquid when a pipe is in position in said pipe restraining means, and said pipe moving means is positioned adjacent said vessel and has said stop means thereon, and means for transferring pipes which have been moved against said stop means laterally of the axis of the pipes into said liquid vessel into said lower rolls of said pipe restraining means and laterally of the axis of the pipes from said lower rolls and out of said vessel.

9. An apparatus as claimed in claim 1 in which said pipe moving means is positioned adjacent the line of said stationary pipe restraining means and has said stop means thereon, and said apparatus further comprising means for transferring pipes which have been moved against said stop means laterally of the axis of the pipes into said pipe restraining means and for transferring pipes laterally from said stationary pipe restraining means after the pipes have been cooled.

* * * * *